US011089835B2

(12) United States Patent
Eldem et al.

(10) Patent No.: US 11,089,835 B2
(45) **Date of Patent: *Aug. 17, 2021**

(54) SOLE STRUCTURE FOR ARTICLE OF FOOTWEAR

(71) Applicant: NIKE, Inc., Beaverton, OR (US)

(72) Inventors: Can Eldem, Portland, OR (US); Wade Flanagan, Portland, OR (US); Ryan Nyberg, Portland, OR (US); Levi J. Patton, Portland, OR (US); Eric S. Schindler, Beaverton, OR (US); Jessica Small, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 171 days.

This patent is subject to a terminal disclaimer.

(21) Appl. No.: 16/200,550

(22) Filed: Nov. 26, 2018

(65) Prior Publication Data

US 2020/0077742 A1 Mar. 12, 2020

Related U.S. Application Data

(63) Continuation of application No. 15/885,676, filed on Jan. 31, 2018, now Pat. No. 10,149,513.

(51) Int. Cl.
*A43B 13/18* (2006.01)
*A43B 13/20* (2006.01)
(Continued)

(52) U.S. Cl.
CPC ..... *A43B 13/20* (2013.01); *A43B 3/0063* (2013.01); *A43B 5/06* (2013.01); *A43B 13/04* (2013.01);
(Continued)

(58) Field of Classification Search
CPC ..... A43B 13/16; A43B 13/20; A43B 13/37; A43B 13/184; A43B 13/188; A43B 13/189; A43B 13/223; A43B 21/00; A43B 3/0063
(Continued)

(56) References Cited

U.S. PATENT DOCUMENTS 5,191,727 A 3/1993 Barry et al.
5,363,570 A 11/1994 Allen et al.
(Continued)

FOREIGN PATENT DOCUMENTS

DE 3245182 A1 5/1983
EP 2445369 A2 5/2012
WO WO-2017079255 5/2017

OTHER PUBLICATIONS

United States Patent and Trademark Office, Office Action for U.S. Appl. No. 15/885,676, dated Apr. 11, 2018.
(Continued)

*Primary Examiner* — Anne M Kozak
(74) *Attorney, Agent, or Firm* — Honigman LLP; Matthew H. Szalach; Jonathan O'Brien

(57) ABSTRACT

A sole structure for an article of footwear includes a forefoot region disposed adjacent an anterior end, a heel region disposed adjacent a posterior end, and a mid-foot region disposed intermediate the forefoot region and the heel region. The sole structure further includes fluid-filled bladder having a first segment extending along a medial side in the heel region, a second segment extending along a lateral side in the heel region, and a web area disposed between the first segment and the second segment. Additionally, the sole structure includes an outer sole member having an upper portion extending from a first end in the forefoot region to a second end in the heel region. The second end of the outer sole member is received on a first side of the web area. The
(Continued)

outer sole member also includes a rib extending downwardly from the upper portion and defining a cavity.

18 Claims, 7 Drawing Sheets

(51) Int. Cl.

| | |
|---|---|
| ***A43B 13/16*** | (2006.01) |
| ***A43B 13/04*** | (2006.01) |
| ***A43B 13/12*** | (2006.01) |
| ***A43B 3/00*** | (2006.01) |
| ***A43B 13/22*** | (2006.01) |
| ***A43B 5/06*** | (2006.01) |
| *A43B 21/00* | (2006.01) |
| *A43B 1/00* | (2006.01) |

(52) U.S. Cl.
CPC ..... *A43B 13/122* (2013.01); *A43B 13/125* (2013.01); *A43B 13/16* (2013.01); *A43B 13/186* (2013.01); *A43B 13/187* (2013.01); *A43B 13/188* (2013.01); *A43B 13/206* (2013.01); *A43B 13/223* (2013.01); *A43B 1/0072* (2013.01); *A43B 13/189* (2013.01); *A43B 21/00* (2013.01)

(58) Field of Classification Search
USPC ..... 36/29
See application file for complete search history.

(56) References Cited

U.S. PATENT DOCUMENTS

| | | | |
|---|---|---|---|
| 5,575,088 | A | 11/1996 | Allen et al. |
| 5,595,004 | A | 1/1997 | Lyden et al. |
| 5,625,964 | A | 5/1997 | Lyden et al. |
| 5,713,141 | A | 2/1998 | Mitchell et al. |
| 5,987,780 | A | 11/1999 | Lyden et al. |
| 6,013,340 | A | 1/2000 | Bonk et al. |
| 6,061,929 | A | 5/2000 | Ritter |
| 6,321,465 | B1 | 11/2001 | Bonk et al. |
| 6,582,786 | B1 | 6/2003 | Bonk et al. |
| 7,392,604 | B2 | 7/2008 | Greene et al. |
| 7,565,754 | B1 | 7/2009 | Acheson et al. |
| 8,225,533 | B2 | 7/2012 | Meschan |
| 8,650,775 | B2 | 2/2014 | Peyton |
| 9,049,901 | B2 | 6/2015 | Dean et al. |
| 9,144,268 | B2 | 9/2015 | Swigart et al. |
| 2005/0132609 | A1 | 6/2005 | Dojan |
| 2005/0167029 | A1 | 8/2005 | Rapaport et al. |
| 2005/0183287 | A1 | 8/2005 | Schindler |
| 2006/0201028 | A1 | 9/2006 | Chan et al. |
| 2006/0277794 | A1 | 12/2006 | Schindler et al. |
| 2007/0137068 | A1 | 6/2007 | Fallon et al. |
| 2008/0005929 | A1 | 1/2008 | Hardy et al. |
| 2008/0083140 | A1 | 4/2008 | Ellis |
| 2008/0216355 | A1 | 9/2008 | Becker et al. |
| 2009/0045547 | A1 | 2/2009 | Schindler et al. |
| 2009/0113757 | A1 | 5/2009 | Banik |
| 2009/0178300 | A1 | 7/2009 | Parker |
| 2009/0235557 | A1 | 9/2009 | Christensen et al. |
| 2010/0251565 | A1 | 10/2010 | Litchfield et al. |
| 2012/0227289 | A1 | 9/2012 | Beers et al. |
| 2014/0075777 | A1 | 3/2014 | Bruce et al. |
| 2014/0075778 | A1 | 3/2014 | Bruce et al. |
| 2014/0075779 | A1 | 3/2014 | Bruce et al. |
| 2015/0040425 | A1 | 2/2015 | Adams |
| 2015/0047227 | A1 | 2/2015 | Fallon et al. |
| 2015/0257481 | A1 | 9/2015 | Campos, II et al. |
| 2015/0272271 | A1 | 10/2015 | Campos, II et al. |
| 2016/0073732 | A1 | 3/2016 | Ernst et al. |
| 2016/0075113 | A1 | 3/2016 | Chang et al. |
| 2016/0120262 | A1 | 5/2016 | Cortez et al. |
| 2016/0120263 | A1 | 5/2016 | Cortez et al. |
| 2016/0192737 | A1 | 7/2016 | Campos, II et al. |
| 2017/0119096 | A1 | 5/2017 | Greene |
| 2017/0172250 | A1 | 6/2017 | Dolan et al. |
| 2017/0265564 | A1 | 9/2017 | Peyton |
| 2017/0265565 | A1 | 9/2017 | Connell et al. |
| 2017/0265566 | A1 | 9/2017 | Case et al. |

OTHER PUBLICATIONS

United States Patent and Trademark Office, Office Action for U.S. Appl. No. 15/885,695, dated Apr. 6, 2018.
United States Patent and Trademark Office, Final Office Action for U.S. Appl. No. 15/885,695, dated Oct. 24, 2018.
United States Patent and Trademark Office, Non-Final Office Action for U.S. Appl. No. 16/037,979, dated Nov. 29, 2018.
United States Patent and Trademark Office, Final Office Action for U.S. Appl. No. 15/885,695, dated Apr. 21, 2020.
United States Patent and Trademark Office, Final Office Action for U.S. Appl. No. 16/037,935, dated Apr. 16, 2020.
European Patent Office (ISA), International Search Report and Written Opinion for International Application No. PCT/US2019/015641, dated Apr. 15, 2019.
European Patent Office (ISA). International Search Report and Written Opinion for International Application No. PCT/US2019/015655, dated Apr. 24, 2019.
European Patent Office (ISA), International Search Report and Written Opinion for International Application No. PCT/US2019/041904, dated Nov. 4, 2019.
European Patent Office (ISA), International Search Report and Written Opinion for International Application No. PCT/US2019/041902, dated Nov. 5, 2019.

SOLE STRUCTURE FOR ARTICLE OF FOOTWEAR

CROSS REFERENCE TO RELATED APPLICATIONS

This application is a continuation of U.S. application Ser. No. 15/885,676, filed on Jan. 31, 2018, the disclosure of which is hereby incorporated by reference in its entirety.

FIELD

The present disclosure relates generally to sole structures for articles of footwear, and more particularly, to sole structures incorporating a fluid-filled bladder.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
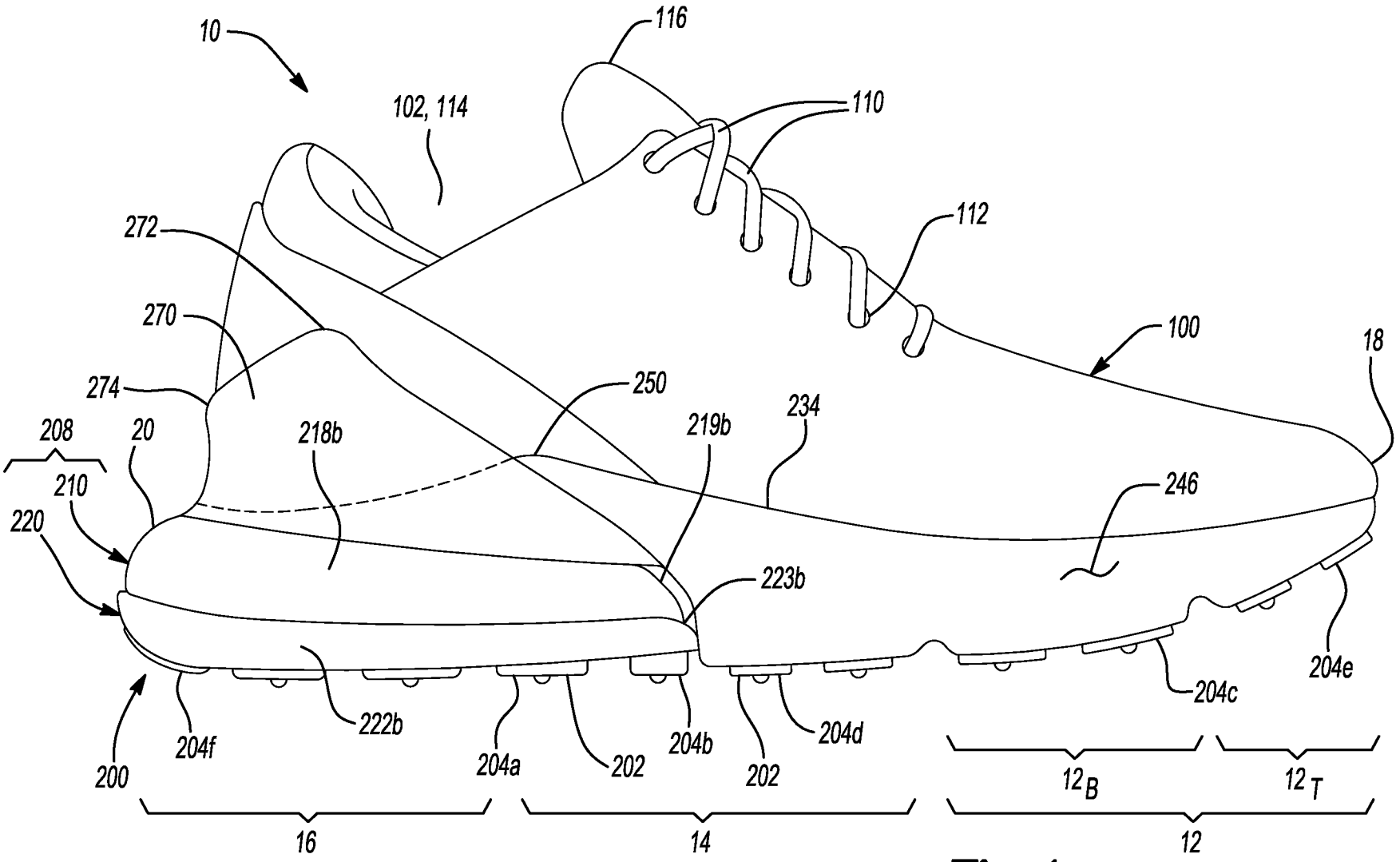
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

With reference to the figures, a sole structure for an article of footwear is provided. The sole structure includes a forefoot region disposed adjacent an anterior end, a heel region disposed adjacent a posterior end, a mid-foot region disposed intermediate the forefoot region and the heel region. A fluid-filled bladder of the sole structure has a first segment extending along a medial side in the heel region, a second segment extending along a lateral side in the heel region, and a web area disposed between the first segment and the second segment. The first segment, the second segment, and the web area define a pocket. An outer sole member has an upper portion extending from a first end in the forefoot region to a second end in the heel region and received on a first side of the web area. A rib extends downwardly from the first end of the upper portion and defines a cavity in a forefoot region of the sole structure. The rib cooperates with the pocket of the fluid-filled bladder to define a recess that extends continuously from the forefoot region to the heel region.

Implementations of the disclosure may include one of more of the following optional features. In some examples, the sole structure includes an inner sole member extending from a first end disposed within the cavity to a second end received on a second side of the web area opposite the outer sole member. Here, the outer sole member may be formed of a first foamed polymeric material and the inner sole member may be formed of a second polymeric material having a greater density than the first foamed polymeric material. Each of fluid-filled bladder, the outer sole member, and the inner sole member may define a portion of a ground-contacting surface of the sole structure.

In some implementations, the rib may be formed along an outer periphery of the sole structure in the forefoot region and the mid-foot region. The rib may have first width in the mid-foot region and a second width in the forefoot region.

In some examples, the first segment may terminate at a first distal end in the mid-foot region and the second segment terminates at a second distal end in the mid-foot region, and wherein the rib extends continuously from a first terminal end opposing the first distal end in the mid-foot region to a second terminal end opposing the second distal end in the mid-foot region.

In some implementations, the rib may include a first segment extending along the lateral side within the mid-foot region and a second segment extending along the lateral side within the forefoot region, the second segment having a greater width than the first segment.

In some examples, the fluid-filled bladder may further include a third segment fluidly coupling the first segment to the second segment and extending along an arcuate path around the posterior end, and a thickness of the fluid-filled bladder tapers continuously and at a constant rate from the posterior end to a first distal end. Here, the sole structure further includes a heel counter extending along each of the first segment, the second segment, and the third segment and formed of the same material as the fluid-filled bladder.

In another aspect of the disclosure, a sole structure for an article of footwear is provided. The sole structure includes a fluid-filled bladder disposed in a heel region of the sole structure. The fluid-filled bladder tapers from a first thickness at a posterior end of the sole structure to a second thickness at a mid-foot region of the sole structure. An outer sole member includes an upper portion extending from a first end in a forefoot region of the sole structure to a second end received by the fluid-filled bladder. A rib extends downwardly from the first end of the upper portion and defines a cavity in a forefoot region of the sole structure. The sole structure further includes an inner sole member having a first end received in the cavity of the outer sole member and a second end received by the fluid-filled bladder in the heel region.

Implementations of the disclosure may include one of more of the following optional features. In some examples, the sole structure includes a heel counter extending from the fluid-filled bladder and overlaying the upper portion of the outer sole member.

In some implementations, the fluid-filled bladder, the outer sole member, and the inner sole member each define a portion of a ground-engaging surface of the sole structure. Optionally, each of the fluid-filled bladder, the outer sole member, and the inner sole member includes one or more traction elements disposed on the ground-engaging surface. A first plurality of the traction elements may each include a protuberance extending therefrom, and a second plurality of the traction elements includes a plurality of serrations formed therein. In some examples, the one or more traction elements includes a first plurality of quadrilateral-shaped traction elements along the first segment of the fluid-filled bladder, a first D-shaped traction element disposed at a distal end of the first segment of the fluid-filled bladder, a second plurality of quadrilateral-shaped traction elements along a medial side of the rib, a second D-shaped traction element disposed at a terminal end of the rib and opposing the first D-shaped traction element, and at least one of an anterior traction element and a posterior traction element extending from the medial side to the lateral side.

In some implementations, the outer sole member includes a plurality of channels formed in a lower surface of the rib along a direction from a medial side of the sole structure to a lateral side of the sole structure.

In some examples, the first end of the inner sole member includes a traction element extending from the forefoot region through the mid-foot region and having a plurality of serrations formed therein. In some implementations, the second end of the inner sole member includes a bulge disposed within the fluid-filled bladder and having a convex shape.

In some implementations, the outer sole member may include a sidewall configured to extend onto an upper of the article of footwear.

Referring to FIGS. 1-8, an article of footwear 10 includes an upper 100 and sole structure 200. The article of footwear 10 may be divided into one or more regions. The regions may include a forefoot region 12, a mid-foot region 14, and a heel region 16. The forefoot region 12 may be subdivided into a toe portion $\mathbf{12}_T$ corresponding with phalanges and a ball portion $\mathbf{12}_B$ associated with metatarsal bones of a foot. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. As shown in FIG. 3A, a longitudinal axis $A_L$ of the footwear 10 extends along a length of the footwear 10 from the anterior end 18 to the posterior end 20, and generally divides the footwear 10 into a lateral side 24 and a medial side 22. Accordingly, the lateral side 24 and the medial side 22 respectively correspond with opposite sides of the footwear 10 and extend through the regions 12, 14, 16.

The upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

Figure 2:
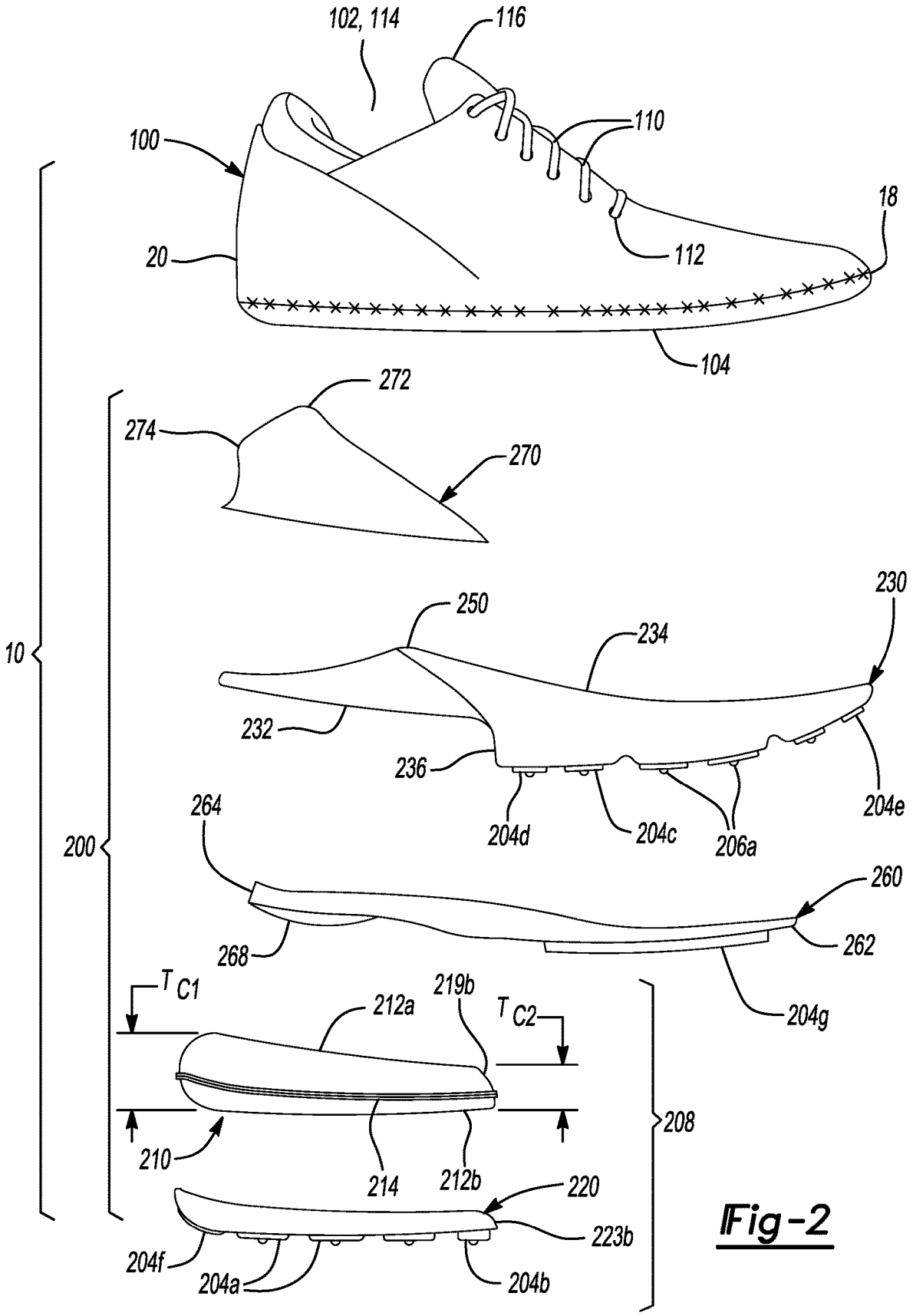
FIG. 2 is an exploded view of the article of footwear of FIG. 1, showing an article of footwear having an upper and a sole structure arranged in a layered configuration.
Figure 8:
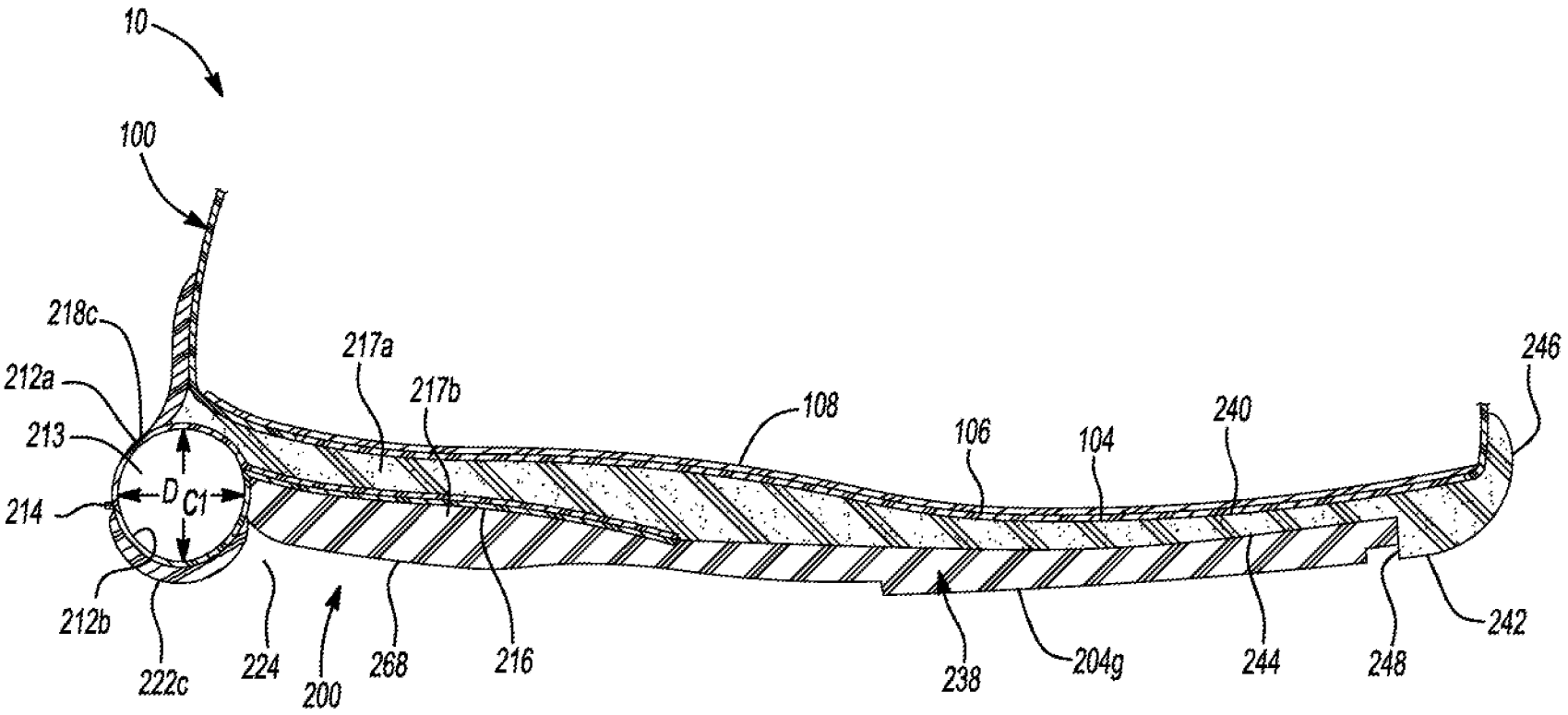
FIG. 8 is a cross-sectional view taken along line 8-8 of FIG. 3B, showing components extending from an anterior end of the sole structure to a poster end of the sole structure.

With reference to FIGS. 2 and 8, in some examples the upper 100 includes a strobel 104 having a bottom surface opposing the sole structure 200 and an opposing top surface defining a footbed 106 of the interior void 102. Stitching or adhesives may secure the strobel to the upper 100. The footbed 106 may be contoured to conform to a profile of the bottom surface (e.g., plantar) of the foot. Optionally, the upper 100 may also incorporate additional layers such as an insole 108 or sockliner that may be disposed upon the strobel 104 and reside within the interior void 102 of the upper 100 to receive a plantar surface of the foot to enhance the comfort of the article of footwear 10. An ankle opening 114 in the heel region 16 may provide access to the interior void 102. For example, the ankle opening 114 may receive a foot to secure the foot within the void 102 and to facilitate entry and removal of the foot from and to the interior void 102.

In some examples, one or more fasteners 110 extend along the upper 100 to adjust a fit of the interior void 102 around the foot and to accommodate entry and removal of the foot therefrom. The upper 100 may include apertures 112 such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 116 that extends between the interior void 102 and the fasteners.

With reference to FIGS. 1-3B and FIGS. 6-8, the sole structure 200 includes a fluid-filled bladder 208 bounding a periphery of the sole structure 200 in the heel region 16. The fluid-filled bladder 208 includes a fluid-filled chamber 210 and an overmold portion 220 joined to the chamber 210 and defining a first portion of a ground-engaging surface 202 of the sole structure 200. The sole structure 200 further includes an outer sole member 230 bounding a periphery of the sole structure 200 in the forefoot region 12 and the mid-foot region 14, and an inner sole member 260 extending from the forefoot region 12 to the heel region 16, as discussed in greater detail below.

With reference to FIGS. 2, 4, 5, and 8, the fluid-filled chamber 210 is formed from a pair of barrier layers 212 joined together define an inner void 213 for receiving a pressurized fluid (e.g. air). The barrier layers 212 include an upper, first barrier layer 212*a* and a lower, second barrier layer 212*b*. The first barrier layer 212*a* and the second barrier layer 212*b* define barrier layers for the chamber 210 by joining together and bonding at a plurality of discrete locations during a molding or thermoforming process. Accordingly, the first barrier layer 212*a* is joined to the second barrier layer 212*b* to form a seam 214 extending around the periphery of the sole structure 200 and a web area 216 extending between the medial and lateral sides 22, 24 of the sole structure 200. The first barrier layer 212*a* and the second barrier layer 212*b* may each be formed from a sheet of transparent, thermoplastic polyurethane (TPU). In some examples, the barrier layers 212*a*, 212*b* may be formed of non-transparent polymeric materials.

Although the seam 214 is illustrated as forming a relatively pronounced flange protruding outwardly from the fluid-filled chamber 210, the seam 214 may be a flat seam such that the upper barrier layer 212*a* and the lower barrier layer 214*a* are substantially continuous with each other. Moreover, the first barrier layer 212*a* and the second barrier layer 212*b* are joined together between the lateral side 24 of the sole structure 200 and the medial side 22 of the sole structure 200 to define a substantially continuous web area 216, as shown in FIGS. 3 and 4.

In some implementations, the first and second barrier layers 212*a*, 212*b* are formed by respective mold portions each defining various surfaces for forming depressions and pinched surfaces corresponding to locations where the seam 214 and/or the web area 216 are formed when the second barrier layer 212*b* and the first barrier layer 212*a* are joined and bonded together. In some implementations, adhesive bonding joins the first barrier layer 212*a* and the second barrier layer 212*b* to form the seam 214 and the web area 216. In other implementations, the first barrier layer 212*a* and the second barrier layer 212*b* are joined to form the seam 214 and the web area 216 by thermal bonding. In some examples, one or both of the barrier layers 212*a*, 212*b* are heated to a temperature that facilitates shaping and melding. In some examples, the layers 212*a*, 212*b* are heated prior to being located between their respective molds. In other examples, the mold may be heated to raise the temperature of the layers 212*a*, 212*b*. In some implementations, a molding process used to form the chamber 210 incorporates vacuum ports within mold portions to remove air such that the first and second layers 212*a*, 212*b* are drawn into contact with respective mold portions. In other implementations, fluids such as air may be injected into areas between the upper and lower layers 212*a*, 212*b* such that pressure increases cause the layers 212*a*, 212*b* to engage with surfaces of their respective mold portions.

Figure 3A:
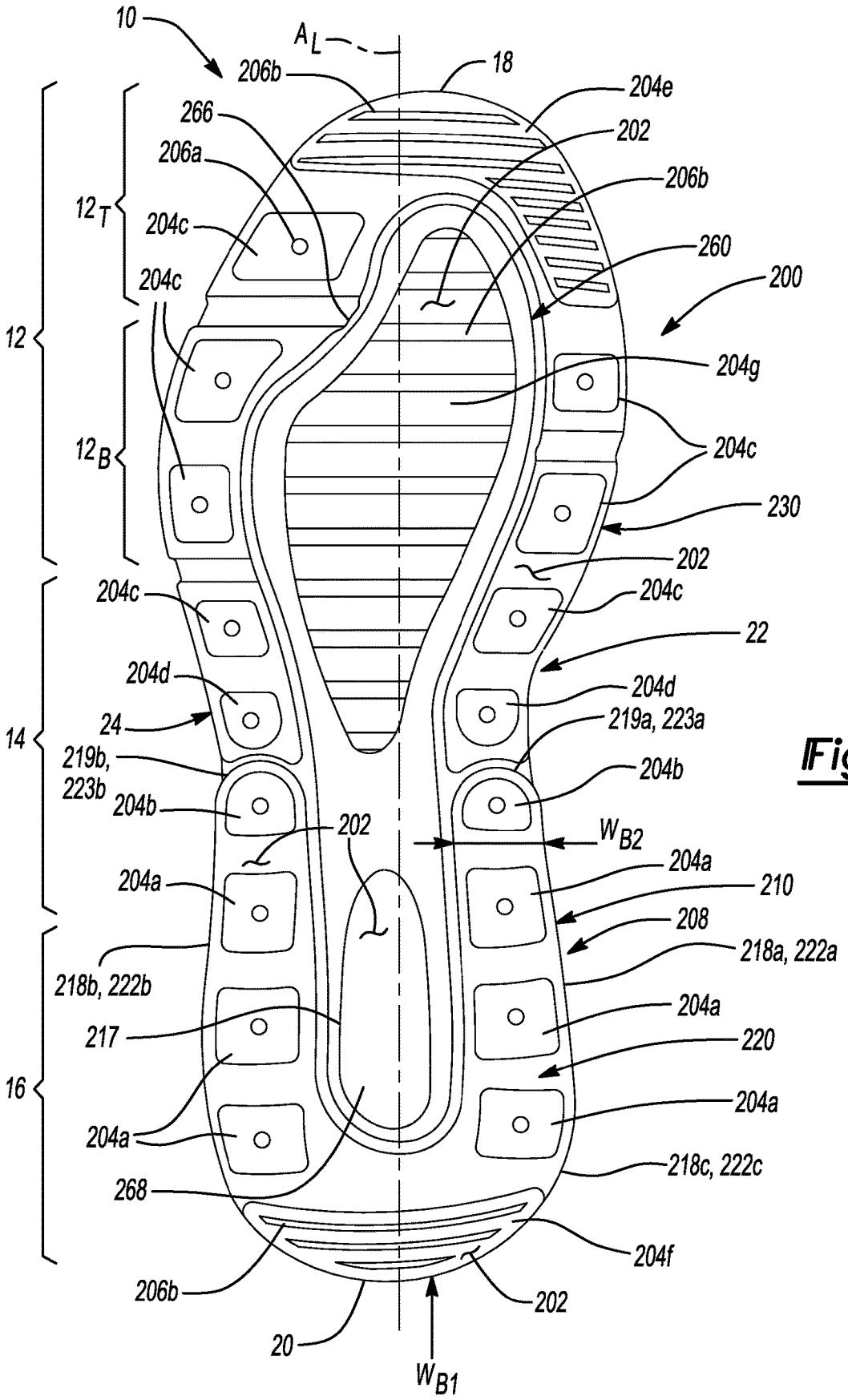
FIGS. 3A and 3B are bottom perspective views of the article of footwear of FIG. 1.
Figure 3B:
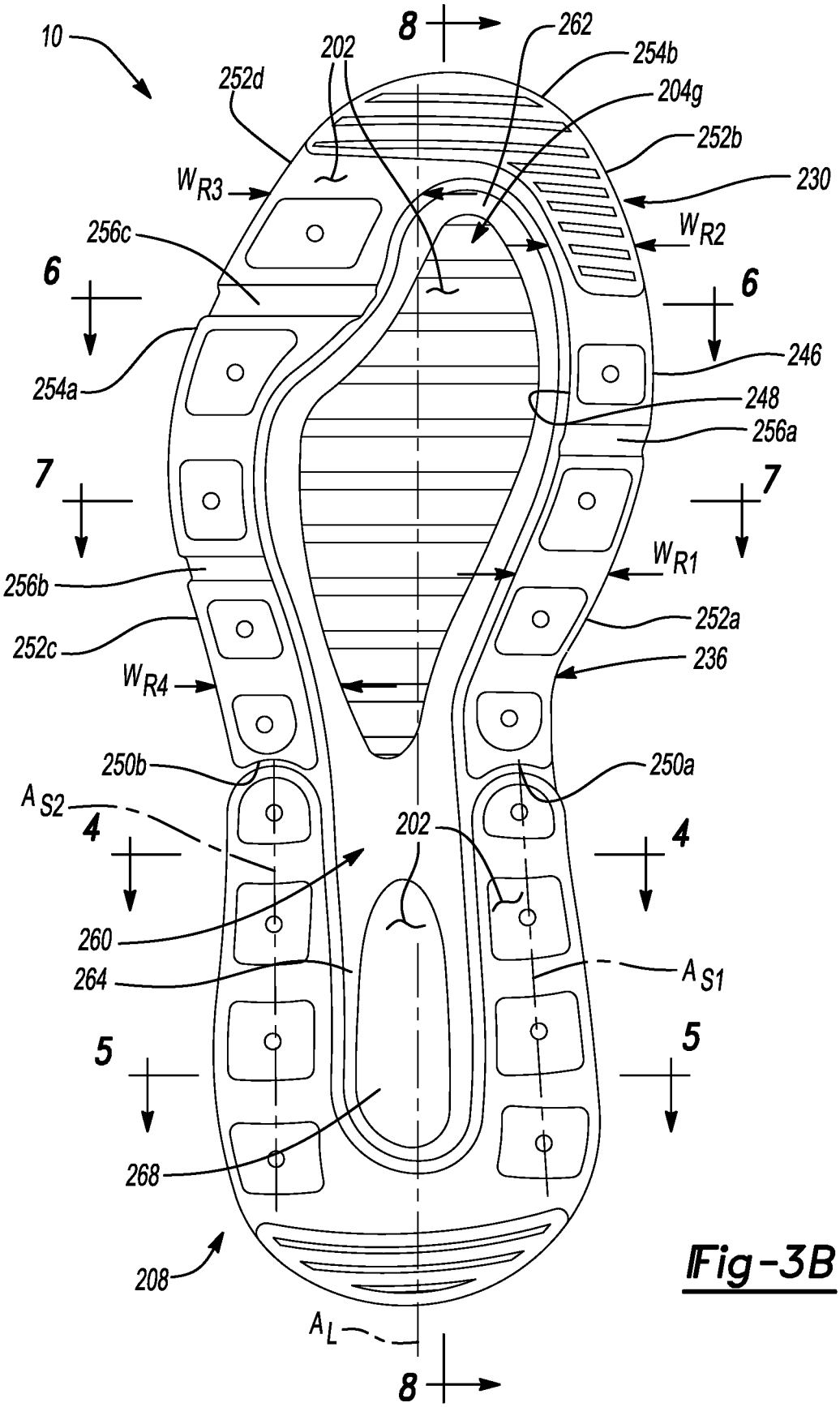
Figure 4:
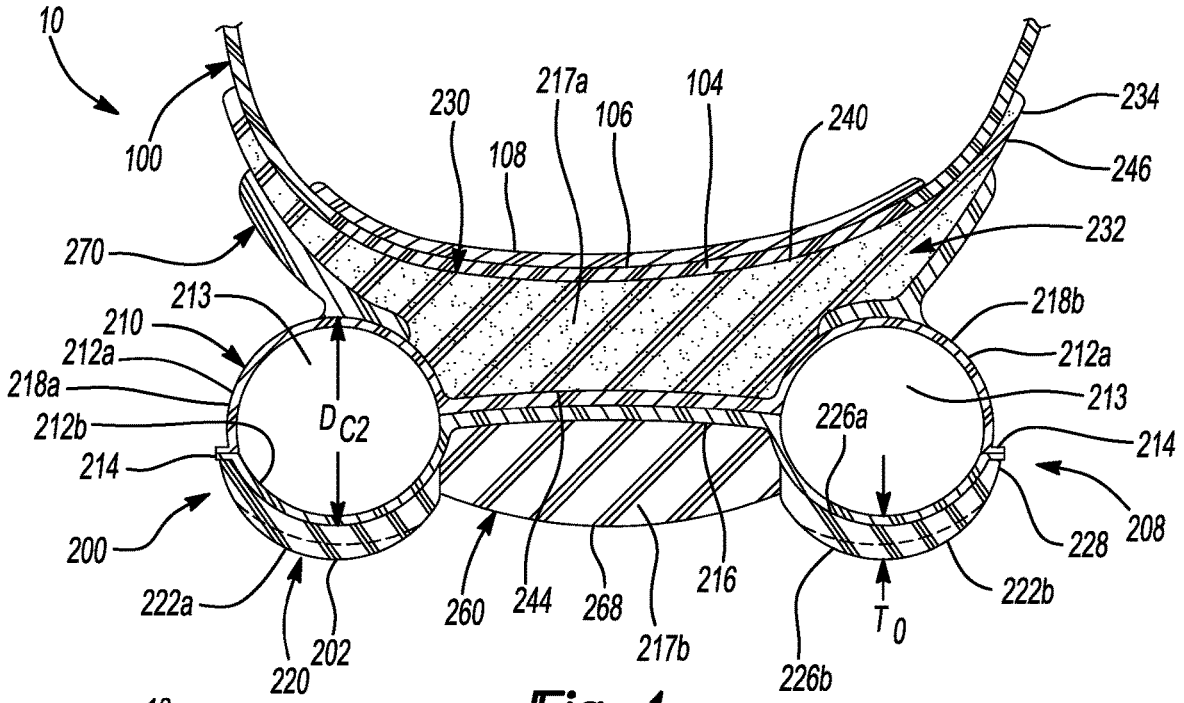
FIG. 4 is a cross-sectional view taken along line 4-4 of FIG. 3B, showing segments of a fluid-filled bladder disposed within a heel region of the sole structure and separated from one another by a web area.

Referring to FIGS. 3A and 3B, the fluid-filled chamber 210 includes a plurality of segments 218*a*-218*c*. In some implementations, the first barrier layer 212*a* and the second barrier layer 212*b* cooperate to define a geometry (e.g., thicknesses, width, and lengths) of each the plurality of segments 218*a*-218*c*. For example, the seam 214 and the web area 216 may cooperate to bound and extend around each of the segments 218*a*-218*c* to seal the fluid (e.g., air) within the segments 218*a*-218*c*. Thus, each segment 218*a*-218*c* is associated with an area of the chamber 210 where the upper and lower layers 212*a*, 212*b* are not joined together and, thus, are separated from one another to form respective voids 213.

In the illustrated example, the chamber 210 includes a series of connected segments 218 disposed within the heel region 16 of the sole structure 200. Additionally or alternatively, the chamber 210 may be located within the forefoot or mid-foot regions 12, 14 of the sole structure. A medial segment 218*a* extends along the medial side 22 of the sole structure 200 in the heel region and terminates at a first distal end 219*a* within the mid-foot region 14. Likewise, a lateral segment 218*b* extends along the lateral side 24 of the sole structure 200 in the heel region 16 and terminates at a second distal end 219*b* within the mid-foot region 14.

A posterior segment 218*c* extends around the posterior end 20 of the heel region 16 and fluidly couples to the medial segment 218*a* and the lateral segment 218*b*. In the illustrated example, the posterior segment 218*c* protrudes beyond the posterior end 20 of the upper 100, such that the upper 100 is offset towards the anterior end 18 from the rear-most portion of the posterior segment 218*c*. As shown, the posterior segment 218*c* extends along a substantially arcuate path to connect a posterior end of the medial segment 218*a* to a posterior end of the lateral segment 218*b*. Furthermore, the posterior segment 218*c* is continuously formed with each of the medial segment 218*a* and the lateral segment 218*b*. Accordingly, the chamber 210 may generally define a horseshoe shape, wherein the posterior segment 218*c* couples to the medial segment 218*a* and the lateral segment 218*b* at respective ones of the medial side 22 and the lateral side 24.

As shown in FIG. 3B, the medial segment 218*a* extends along a first longitudinal axis $A_{S1}$ in a direction from the posterior end 20 to the anterior end 18, and the lateral segment 218*b* extends along a second longitudinal axis $A_{S2}$ in the direction from the posterior end 20 to the anterior end 18. Accordingly, the first segment 218*a* and the second segment 218*b* extend generally along the same direction from the third segment 218*c*. The first longitudinal axis $A_{S1}$, the second longitudinal axis $A_{S2}$, and the arcuate path of the posterior segment 218*c* may all extend along a common plane.

One or both of the first longitudinal axis $A_{S1}$ and the second longitudinal axis $A_{S2}$ may converge with longitudinal axis $A_L$ of the footwear. Alternatively, the first longitudinal axis $A_{S1}$ and the second longitudinal axis $A_{S2}$ may converge with each other along a direction from the third segment 218*c* to the distal ends 219*a*, 219*b*. In some examples, the medial segment 218*a* and the lateral segment 218*b* may have different lengths. For instance, the lateral segment 218*b* may extend farther along the lateral side 24 and into the mid-foot region 14 than the medial segment 218*a* extends along the medial side 22 into the mid-foot region 14.

Figure 5:
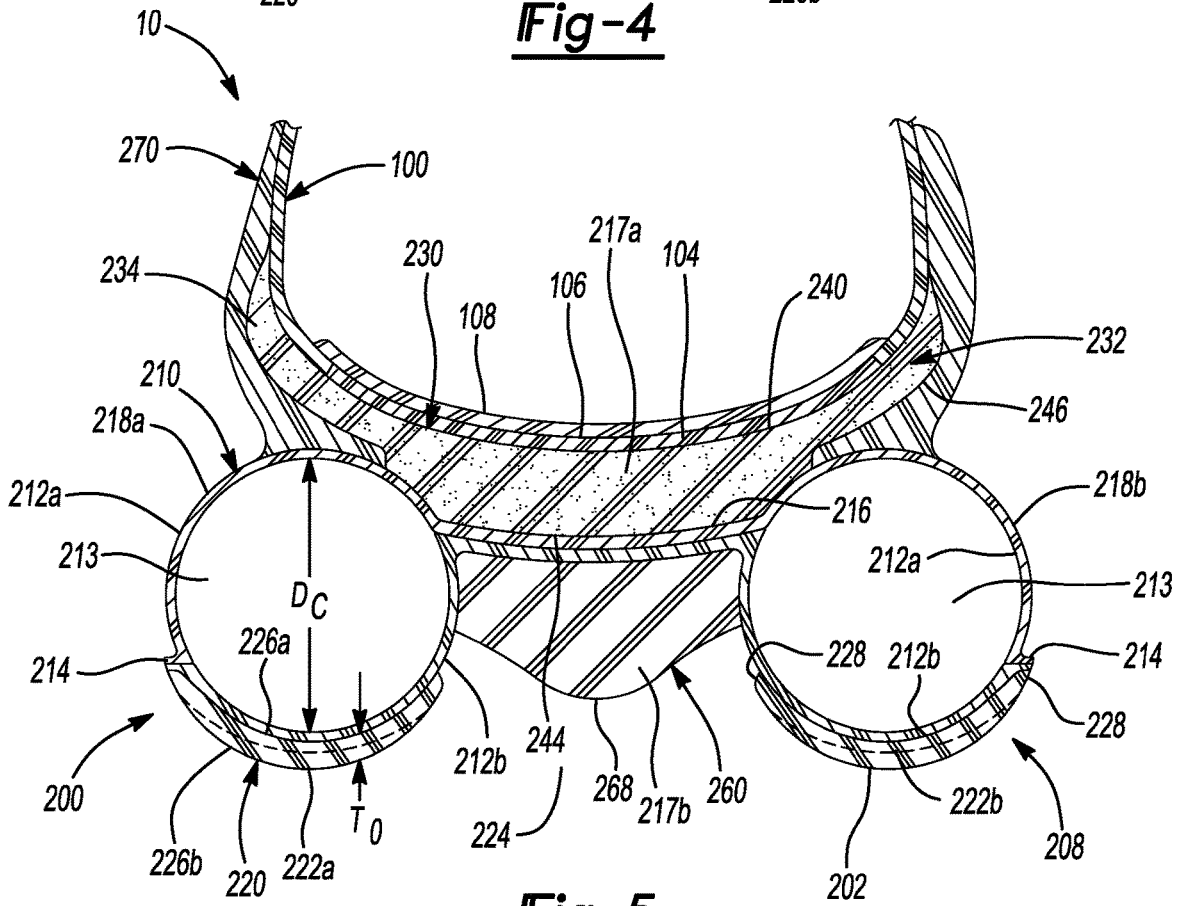
FIG. 5 is a cross-sectional view taken along line 5-5 of FIG. 3B showing segments of a fluid-filled bladder disposed within a heel region of the sole structure and separated from one another by a web area.

As shown in FIGS. 4, 5, and 8, each segment 218*a*-218*c* may be tubular and define a substantially circular cross-sectional shape. Accordingly, diameters $D_C$ of the segments 218*a*-218*c* correspond to both thicknesses $T_C$ and widths $W_C$ of the chamber 210. The thicknesses $T_C$ of the chamber 210 are defined by a distance between the second barrier layer 212*b* and the first barrier layer 212*a* in a direction from the ground-engaging surface 202 to the upper 100, while the widths $W_C$ of the bladder are defined by a distance across the interior void 213, taken perpendicular to the thickness $T_C$ of the chamber 210. In some examples, thicknesses $T_C$ and widths $W_C$ of the chamber 210 may be different from each other.

At least two of the segments 218*a*-218*c* may define different diameters $D_C$ of the chamber 210. For example, one or more segments 218*a*-218*c* may have a greater diameter $D_C$ than one or more of the other segments 218*a*-218*c*. Additionally, the diameters $D_C$ of the segments may taper from one end to another. As shown in FIGS. 1 and 2, the diameter $D_C$ of the chamber 210 tapers from the posterior end 20 to the mid-foot region 14 to provide a greater degree of cushioning for absorbing ground-reaction forces of greater magnitude that initially occur in the heel region 16 and lessen as the mid-foot region 14 of the sole structure 200 rolls for engagement with the ground surface. More specifically, the chamber 210 tapers continuously and at a constant rate from a first diameter $D_{C1}$ at the posterior end 20 (see FIG. 8) to a second diameter $D_{C2}$ at the mid-foot region 14 (see FIG. 4). As illustrated, the first diameter $D_{C1}$ is defined by the posterior segment 218*c* and the second diameter $D_{B2}$ is defined at the distal ends 219*a*, 219*b* of the medial and lateral segments 218*a*, and 218*b*. In some examples, the second diameter $D_{C2}$ of the chamber 210 is the same at each of the medial and lateral sides 22, 24. However, in some examples, the second diameter $D_{C2}$ provided at the distal end 219*a* of the medial segment 218*a* may be different than a diameter of the chamber 210 at the distal end 219*b* of the lateral segment 218*b*.

As shown in FIGS. 1 and 3A, the respective distal ends 219*a*, 219*b* of the medial segment 218*a* and the lateral segment 218*b* are semi-spherical, wherein both the thickness $T_C$ and a width $W_C$ of the chamber 210 decrease along a direction towards the distal ends 219*a*, 219*b*. The distal ends 219*a*, 219*b* operate as an anchor point for the respective segments 218*a*, 218*b* as well as an anchor point for the chamber 210 as a whole, for retaining the shape thereof when loads such as shear forces are applied thereto.

Each of the segments 218*a*-218*c* may be filled with a pressurized fluid (i.e., gas, liquid) to provide cushioning and stability for the foot during use of the footwear 10. In some implementations, compressibility of a first portion of the plurality of segments 218*a*-218*c* under an applied load provides a responsive-type cushioning, while a second portion of the segments 218*a*-218*c* may be configured to provide a soft-type cushioning under an applied load. Accordingly, the segments 218*a*-218*c* of the chamber 210 may cooperate to provide gradient cushioning to the article of footwear 10 that changes as the applied load changes (i.e., the greater the load, the more the segments 218*a*-218*c* are compressed and, thus, the more responsive the footwear 10 performs).

In some implementations, the segments 218*a*-218*c* are in fluid communication with one another to form a unitary pressure system for the chamber 210. The unitary pressure system directs fluid through the segments 218*a*-218*c* when under an applied load as the segments 218*a*-218*c* compress or expand to provide cushioning, stability, and support by attenuating ground-reaction forces especially during forward running movements of the footwear 10. Optionally, one or more of the segments 218*a*-218*c* may be fluidly isolated from the other segments 218*a*-218*c* so that at least one of the segments 218*a*-218*c* can be pressurized differently.

In other implementations, one or more cushioning materials, such as polymer foam and/or particulate matter, are enclosed by one or more of the segments 218*a*-218*c* in place of, or in addition to, the pressurized fluid to provide cushioning for the foot. In these implementations, the cushioning materials may provide one or more of the segments 218*a*-218*c* with cushioning properties different from the segments 218*a*-218*c* filled with the pressurized fluid. For example, the cushioning materials may be more or less responsive or provide greater impact absorption than the pressurized fluid.

With continued reference to FIGS. 3-5, the segments 218*a*-218*c* cooperate to define a pocket 217 within the chamber 210. As shown, the pocket 217 is formed between the medial segment 218*a* and the lateral segment 218*b*, and extends continuously from the posterior segment 218*c* to an opening between the distal ends 219*a*, 219*b* of the chamber 210. In the illustrated example, the web area 216 is disposed within the pocket 217. As shown in FIGS. 4, 5, and 8, the web area 216 is located vertically intermediate with respect to a thickness of the chamber 210, such that the web area 216 is spaced between upper and lower surfaces of the chamber 210. Accordingly, the web area 216 separates the pocket 217 into an upper pocket 217*a* disposed on a first side of the web area 216 facing the upper 100, and a lower pocket 217*b* disposed on an opposing second side of the web area 216 facing the ground surface. As discussed below, the upper pocket 217*a* may be configured to receive the outer sole member 230, while the lower pocket 217*b* is configured to receive the second sole member 260. In some examples, the web area 216 may not be present within the pocket 217, and the pocket 217 may be uninterrupted from the ground surface to the upper 100.

In some implementations, an overmold portion 220 extends over a portion of the chamber 210 to provide increased durability and resiliency for the segments 218*a*-218*c* when under applied loads. Accordingly, the overmold portion 220 is formed of a different material than the chamber 210, and includes at least one of a different thickness, a different hardness, and a different abrasion resistance than the second barrier layer 212*b*. In some examples, the overmold portion 220 may be formed integrally with the second barrier layer 212*b* of the chamber 210 using an overmolding process. In other examples the overmold portion 220 may be formed separately from the second barrier layer 212*b* of the chamber 210 and may be adhesively bonded to the second barrier layer 212*b*.

The overmold portion 220 may extend over each of the segments 218*a*-218*b* of the chamber 210 by attaching to the second barrier layer 212*b* to provide increased durability and resiliency for the chamber 210 where the separation distance between the second barrier layer 212*b* and the first barrier layer 212*a* is greater, or to provide increased thickness in specific areas of the chamber 210. Accordingly, the overmold portion 220 may include a plurality of segments 222*a*-222*c* corresponding to the segments 218*a*-218*c* of the chamber 210. Thus, the overmold portion 220 may be limited to only attaching to areas of the second barrier layer 212*b* that partially define the segments 218*a*-218*c* and, therefore, the overmold portion 220 may be absent from the seam 214 and web area 216. More specifically, the segments 222*a*-222*b* of the overmold portion 220 may cooperate with the segments 218*a*-218*c* of the chamber 210 to define an opening 224 to the lower pocket 217*b* configured to receive a portion of the inner sole member 260 therein, as discussed below.

In some examples, the overmold portion 220 includes an opposing pair of surfaces 226 defining a thickness $T_O$ of the overmold portion. The surfaces 226 include a concave inner surface 226*a* bonded to the second barrier layer 212*b* and a convex outer surface 226*b* defining a portion of the ground-engaging surface 202 of the sole structure 200. Accordingly, the overmold portion 220 defines a substantially arcuate or crescent-shaped cross section. As shown in FIGS. 4 and 5, the concave inner surface 226*a* and the convex outer surface 226*b* may be configured such that the thickness $T_O$ of the overmold portion 220 tapers from an intermediate portion towards a peripheral edge 228. In some instances, the surfaces 226*a*, 226*b* may converge with each other to define the peripheral edge 228, and to provide a substantially continuous, or flush, transition between the overmold portion 220 and the chamber 210. As shown in FIGS. 4, 5, and 8, the peripheral edge 228 may abut the seam 214 of the chamber 210 such that the outer surface 226*b* is substantially flush and continuous with a distal end of the seam 214.

With continued reference to FIGS. 1-5 and 8, the fluid-filled bladder 208 may be continuously exposed along an outer periphery of the heel region 16 from the first distal end 219*a* to the second distal end 219*b*. For example, the first barrier layer 212*a* may be continuously exposed along the outer periphery of the sole structure 200 between the upper 100 and the overmold portion 220, such that the transparent first barrier layer 212*a* is exposed around the periphery of the heel region 16. Similarly, the overmold portion 220 may be continuously exposed along the outer periphery of the sole structure from the first distal end 219*a* to the second distal end 219*b*.

The outer sole member 230 includes an upper portion 232 having a sidewall 234, and a rib 236 that cooperates with the upper portion 232 to define a cavity 238 for receiving the inner sole member 260, as discussed below. The outer sole member 230 may be formed from an energy absorbing material such as, for example, polymer foam. Forming the outer sole member 230 from an energy-absorbing material such as polymer foam allows the outer sole member 230 to attenuate ground-reaction forces caused by movement of the article of footwear 10 over ground during use.

With reference to FIGS. 4-8, the outer sole member 230 includes an upper surface 240 that extends continuously from the anterior end 18 to the posterior end 20 between the medial side 22 and the lateral side 24, and opposes the strobel 104 of the upper 100 such that the upper portion 232 substantially defines a profile of the footbed 106 of the upper 100. The outer sole member 230 further includes a lower surface 242 that is spaced apart from the upper surface 240 and defines a portion of the ground-engaging surface 202 of the sole structure 200 in the forefoot region 12 and the mid-foot region 14. An intermediate surface 244 of the outer sole member 230 is recessed from the lower surface 242 towards the upper surface 240. A peripheral side surface 246 extends around an outer periphery of the sole structure 200, and joins the upper surface 240 to the lower surface 242. An inner side surface 248 is spaced inwardly from the peripheral side surface 246 to define a width $W_R$ of the rib 236, and extends between lower surface 242 and the intermediate surface 246.

The upper surface 240, the intermediate surface 242, and the peripheral side surface 246 cooperate to form the upper portion 232 of the outer sole member 230. The upper portion 232 extends from a first end adjacent the anterior end 18 to a second end adjacent the posterior end 20. As shown in FIGS. 4, 5, and 8, the second end of the upper portion 232 may be at least partially received within the upper pocket 217*a* of the chamber 210, on the first side of the web area 216. Accordingly, the sole structure 200 may include a polymer foam layer of the outer sole member 230 disposed between the first barrier layer 212*a* of the chamber 210 and the upper 100. Thus, the foam layer of the sole structure 200 is an intermediate layer that indirectly attaches the first barrier layer 212*a* of the chamber 210 to the upper 100 by joining the first barrier layer 212*a* of the chamber 210 to the upper 100 and/or to the bottom surface of the strobel 104, thereby securing the sole structure 200 to the upper 100. Moreover, the foam layer of the outer sole member 230 may also reduce the extent to which the first barrier layer 212*a* attaches directly to the upper 100 and, therefore, increases durability of the footwear 10.

As shown, the upper surface 240 may have a contoured shape. Particularly, the upper surface 240 may be convex, such that an outer periphery of the upper surface 240 may extend upwardly and converge with the peripheral side surface 242 to form the sidewall 234 extending along the outer periphery of the sole structure 200. The sidewall 234 may extend at least partially onto an outer surface of the upper 100 such that the outer sole member 230 conceals a junction between the upper 100 and the strobel 104.

With reference to FIG. 1, a height of the sidewall 234 from the lower surface 242 may increase continuously from the anterior end 18 through the mid-foot region 14 to an apex 250, and then decrease continuously from the apex to the posterior end 20. The sidewall 234 is generally configured to provide increased lateral reinforcement to the upper 100. Accordingly, providing the sidewall 234 with increased height adjacent the heel region 16 provides the upper with additional support to minimize lateral movement of the foot within the heel region 16.

Figure 6:
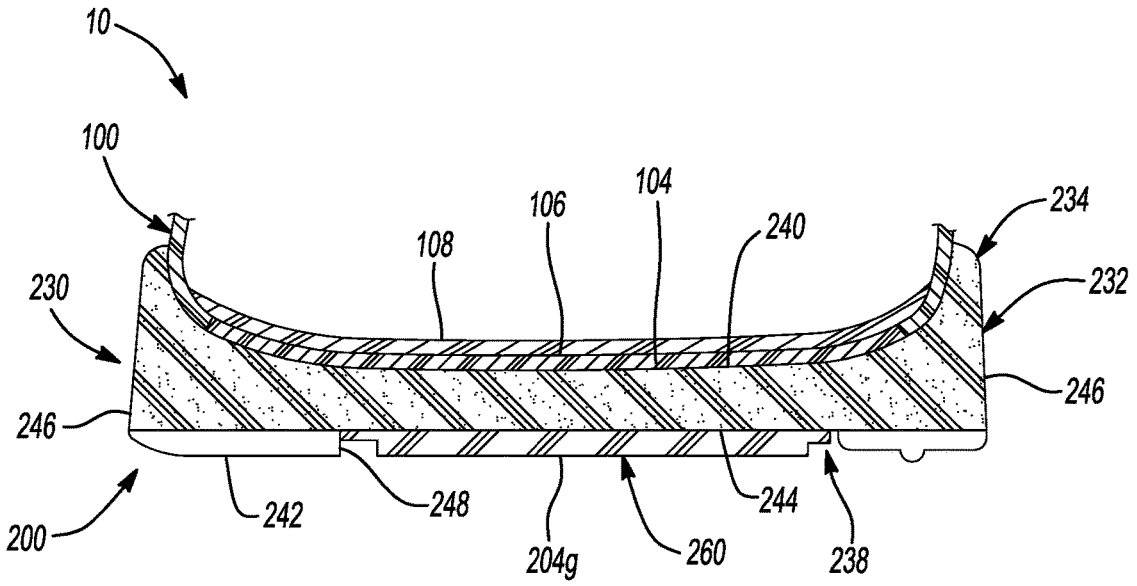
FIG. 6 is a cross-sectional view taken along line 6-6 of FIG. 3B, showing components of the sole structure within the forefoot region.
Figure 7:
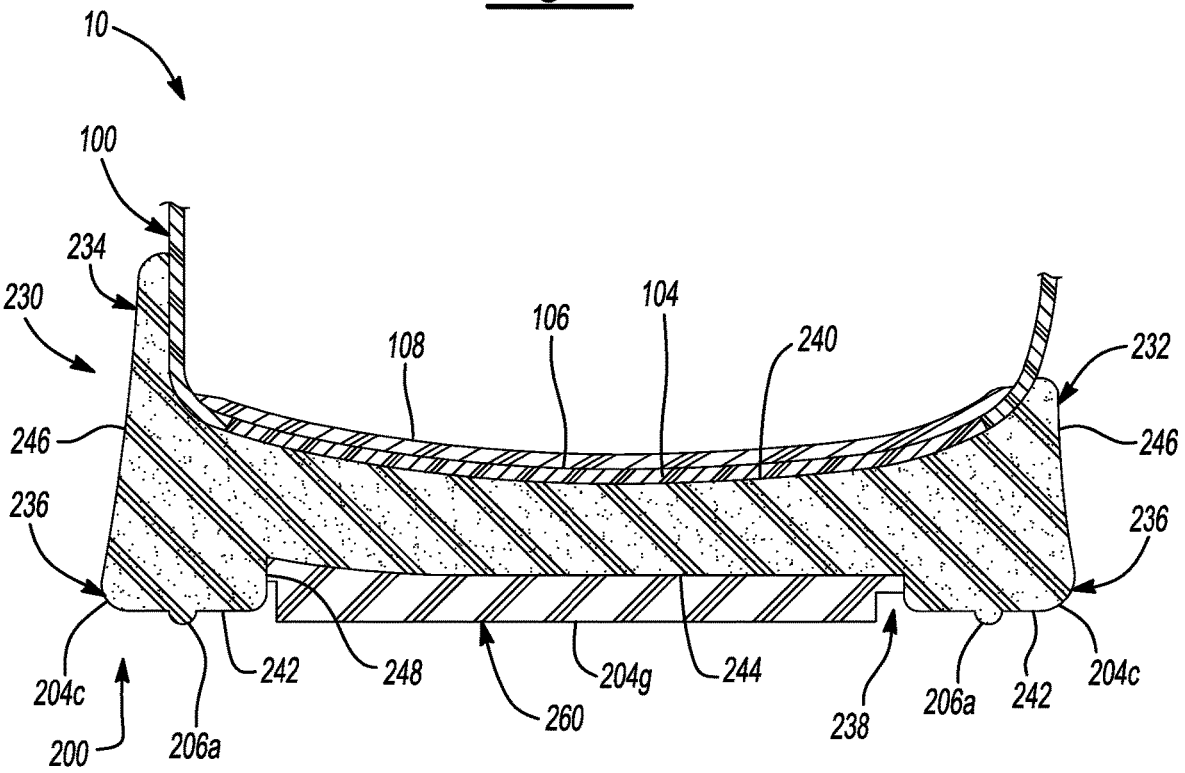
FIG. 7 is a cross-sectional view taken along line 7-7 of FIG. 3B, showing components of the sole structure within a mid-foot region of the sole structure.

With continued reference to FIGS. 6 and 7, the rib 236 extends downwardly from the upper portion 232 to the lower surface 242, and forms a portion of the ground engaging surface 202 within the forefoot region 12 and the mid-foot region 14. A distance between the peripheral side surface 246 and the inner surface 248 defines a width $W_R$ of the rib 236. As shown in FIG. 3B, the width $W_R$ of the rib 236 may be variable along the perimeter of the sole structure 200.

With reference to FIG. 3B, the rib 236 extends continuously from a first terminal end 250*a* in the mid-foot region 14 opposing the first distal end 219*a* of the lateral segment 218*b* of the chamber 210, around the periphery of the forefoot region 12, to a second terminal end 250*b* in the mid-foot region 14 opposing the second distal end 219*b* of the lateral segment 218*b*. As shown, each of the first terminal end 250*a* and the second terminal end 250*b* may be defined by arcuate, or concave surfaces configured to complement or receive the semi-spherical distal ends 219*a*, 219*b* of the bladder 208. Accordingly, the bladder 208 and the rib 236 cooperate to define a substantially continuous ground-engaging surface 202 around a periphery of the sole structure 200.

The rib 236 includes a plurality of segments 252 extending along the medial side 22 and the lateral side 24 and converging at the anterior end 18 of the sole structure 200. The segments 252 of the rib 236 include a first segment 252*a* extending from the first distal end 238*a* along the medial side 22 within the mid-foot region 14, a second segment 252*b* connected to the first segment 252*a* and extending along the medial side 22 between the mid-foot region 14 and the anterior end 18, a third segment 236*c* connected to the second segment 252*b* and extending along the lateral side 24 from the anterior end 18 to the mid-foot region 14, and a fourth segment 252*d* connected to the third segment 252*c* and extending along the lateral side 24 to the second terminal end 250*b* within the mid-foot region 14.

As discussed above, the width $W_R$ of the rib 236 may be variable along the perimeter of the sole structure 200. For example, one or more of the segments 252*a*-252*d* may have a different width $W_R$ than one or more of the other segments 252*a*-252*d*. In the illustrated example, the first segment 252*a*, the second segment 252*b*, and the fourth segment 252*d* each have substantially similar widths $W_{R1}$, $W_{R2}$, $W_{R4}$ while the third segment 252*c* has a greater width $W_{R3}$. Accordingly, the rib 236 may include transitions 254 joining opposing ends of segments 252 of different thicknesses. For instance, in the illustrated example the rib 236 includes a first transition 254*a* disposed between the third segment 252*c* and the fourth segment 252*d* along the lateral side 22 of the sole structure 200 and within the ball portion $12_B$ of the forefoot region 12. The rib 236 further includes a second transition 254*b* between the second segment 252*b* and the fourth segment 252*d* along the anterior end 18.

With continued reference to FIGS. 3B, 6 and 7, the intermediate surface 244 and the inner side surface 248 cooperate to define the cavity 238 of the outer sole member 230. Accordingly, a depth of the cavity 238 corresponds distance between the lower surface 242 and the intermediate surface 244, and a peripheral profile of the cavity 238 corresponds to an inner profile of the rib 236 defined by the inner side surface 248. The cavity 238 extends from a first end within the toe portion $12_T$ of the forefoot region 12 to an opening disposed in the mid-foot region 14 of the sole structure, between the terminal ends 250*a*, 250*b*. Accordingly, the opening of the cavity 238 of the outer sole member 230 may oppose the opening of the lower pocket 217*b* of the chamber 210, such that the cavity 238 and the lower pocket 217*b* provide a substantially continuous recess for receiving the inner sole member 260.

The outer sole member 230 may further include one or more channels 256 formed in the lower surface 242, which extend from the peripheral side surface 246 to the inner side surface 248, along a direction substantially perpendicular to the longitudinal axis $A_L$ of the footwear 10. In the illustrated example, each of the channels 256 is substantially semi-cylindrical in shape. The channels 256 may include a first channel 256*a* disposed on the medial side 22, between the first segment 252*a* and the second segment 252*b*. Particularly, the first channel 256*a* may be formed between the forefoot region 12 and the mid-foot region 14. A second channel 256*b* may be formed in an intermediate portion of the third segment 252*c*, within the mid-foot region, and a third channel 256*c* may be formed in an intermediate portion of the fourth segment 252*d*. Particularly, the third channel 256*c* may be formed at an end of the first transition 254*a* adjacent the fourth segment 252*d*, and intermediate the toe portion $12_T$ and the ball portion $12_B$ of the forefoot region 12.

With reference to FIG. 3B, the inner sole member 260 includes a first end 262 received within the cavity 238 of the outer sole member 230, and a second end 264 received within the lower pocket 217*b* of the bladder 208. The inner sole member 260 is formed of a different polymeric material than the outer sole member 230 to impart desirable characteristics to the sole structure 200. For example, the inner sole member 260 may be formed of a material having a greater coefficient of friction, a greater resistance to abrasion, and a greater stiffness than the foamed polymer material of the outer sole member 230. Accordingly, the inner sole member 260 may function as a shank to control a stiffness or flexibility of the sole structure 200. In some examples the inner sole member 260 may be formed from a polymeric foam material. Additionally or alternatively, the inner sole member 260 may be formed of a non-foamed polymeric material, such as rubber.

The first end 262 of the inner sole member 260 is disposed within the cavity 238 of the outer sole member 230, and has an outer profile that compliments the profile of the inner side surface 248 of the outer sole member. Accordingly, the outer profile of the first end 262 may include a depression 266 formed in the forefoot region 12 along the lateral side 24, which is configured to cooperate with the relatively wide fourth segment 252*d* of the rib 236.

The first end 262 may form a portion of the ground-engaging surface 202 of the sole structure 200, and includes one of the traction elements 204, 204*g* extending from the forefoot region 12 to the mid-foot region 14, as described in greater detail below. The second end 264 of the inner sole member 260 is received within the lower pocket 217*b* of the chamber 210, on the second side of the web area 216. The second end 264 is surrounded by the medial segments 218*a*, 222*a*, the lateral segments 218*b*, 222*b*, and the posterior segments 218*c*, 222*c* of the bladder 208. Accordingly, the web area 216 may be disposed between the upper portion 232 of the outer sole member 230 and the second end 264 of the inner sole member 260.

The second end 264 may include substantially convex-shaped bulge 268 forming a portion of the ground-engaging surface 202. As shown in FIGS. 4 and 5, the bulge 268 is formed where a thickness of the inner sole member 260 increases towards the longitudinal axis $A_L$ to provide an area of increased thickness along the center of the sole structure 200. The geometry of the bulge 268 may be variable along the length of the sole structure 200 to impart desirable characteristics of energy absorption. As shown in FIGS. 4 and 5, a profile of the bulge 268 within the mid-foot region 14 may be relatively flat compared to a profile of the bulge 268 within the heel region 16, such that the energy absorption rate of the bulge 268 within the mid-foot region 14 is relatively constant while the energy absorption rate within the heel region 16 is progressive. Additionally or alternatively, the bulge 268 may be spaced apart from the portion of the ground-engaging surface 202 defined by the bladder 208, such that the bulge 268 only engages with the ground-surface under some conditions, such as periods of relatively high impact.

As discussed above, the overmold portion 220 of the bladder 208, the outer sole member 230, and the inner sole member 260 cooperate to define the ground-engaging surface 202 of the sole structure 200, which includes a plurality of traction elements 204 extending therefrom. The traction elements 204 are configured to engage with a ground surface to provide responsiveness and stability to the sole structure 200 during use.

The outer surface 226*b* of the overmold portion 220 may include a plurality of the traction elements 204 formed thereon. For example, each of the medial segment 222*a* and the lateral segment 222*b* may include a plurality of quadrilateral-shaped traction elements 204*a* disposed between the posterior segment 222*c* and respective distal ends 223*a*, 223*b* of the overmold portion 220. The medial segment 222*a* and the lateral segment 222*b* may each further include a distal traction element 204*b* associated with the respective distal ends 223*a*, 223*b*. The distal traction elements 204*b* are generally D-shaped and have an arcuate side facing towards a center of the mid-foot region 14 and a straight side facing away from the mid-foot region 14.

Similarly, the lower surface 242 of the outer sole member 230 includes a plurality of quadrilateral-shaped traction elements 204*c* formed along each of the medial side 22 and the lateral side 24, intermediate the respective terminal ends 250*a*, 250*b* and the anterior end 18. The lower surface 242 further includes a pair of D-shaped traction elements 204*d* disposed at each of the terminal ends 250*a*, 250*b* of the rib 236, and opposing the distal traction elements 204*b* of the bladder 208. Accordingly, an arcuate side of the traction elements 204*d* opposes the arcuate side of the D-shaped traction elements 204*b* formed on the overmold portion 220, and a straight side faces towards the anterior end 18.

The ground-engaging surface 202 of the sole structure 200 further includes an anterior traction element 204*e* formed on the outer sole member 230, and a posterior traction element 204*f* formed on the overmold portion 220 of the bladder 208. As shown in FIG. 3, the anterior traction element 204*e* extends from a first end on the second segment 252*b* on the medial side 22, and around the anterior end 18 to a second end on the fourth segment 252*d* on the lateral side 24. Likewise, the posterior traction element 204*f* extends along the posterior segment 222*c* of the overmold 220, from a first end adjacent the medial side 22 to a second end adjacent the lateral side 24.

As discussed above, the first end 262 of the inner sole member 260 may include an inner traction element 204*g* extending from a first end in an intermediate portion of the forefoot region 12 to a second end in an intermediate portion of the mid-foot region 14. As shown, the inner traction element 204 has an outer profile corresponding to and offset from the profile of the inner side surface 248. The second end of the inner traction element 204*g* is substantially aligned with the terminal ends 250*a*, 250*b* of the rib 236 in a direction from the medial side 22 to the lateral side 24.

Each of the tractions elements 204*a*-204*g* may include a ground-engagement feature 206 formed therein, which is configured to interface with the ground surface to improve traction between the ground-engaging surface 202 and the ground surface. As shown, the traction elements 204*a*-204*d* formed along the medial side 22 and the lateral side 24 may include a single, centrally-located protuberance 206*a* extending therefrom, which is configured to provide a desired degree of engagement with the ground surface. In some examples, the protuberance 206*a* is a single hemispherical protuberance. Additionally or alternatively, the traction elements 204*a*-204*d* may include a plurality of protuberances having polygonal or cylindrical shapes, for example, The ground-engagement features 206 may further includes one or more serrations 206*b* formed in the traction elements 204. For example, each of the anterior traction element 204*e* and the posterior traction element 204*f* may include elongate serrations 206*b* extending from the medial side 22 towards the lateral side 24. Similarly, the interior traction element 204*g* may include a plurality of parallel serrations 206*b* evenly spaced along an entire length of the inner traction element 204*g*, each extending from the medial side 22 towards the lateral side 24. The serrations 206*b* of the interior traction element 204*g* may extend continuously through an entire width of the interior traction element 204*g*, while the serrations 206*b* formed in the anterior and posterior traction elements 204*e*, 204*f* may be formed within an outer periphery of the traction elements 204*e*, 204*f*.

The sole structure 200 further includes a heel counter 270 formed of the same transparent TPU material as the first barrier layer 212*a* and extending over the outer sole member 230. As shown, the heel counter 270 extends from the first distal end 219*a* of the chamber 210, around the posterior end 20, and to the second distal end 219*b* of the chamber 210.

With reference to FIG. 1, a height of the heel counter 270 increases from the second distal end 219*b* of the chamber 210 to a vertex 272 in the heel region of the lateral side 24, and then decreases to the posterior end 20. Although not illustrated, the heel counter 270 is similarly formed along the medial side 22, such that the height of the heel counter 270 is cupped around the posterior end 20 of the upper 100 between the vertex 272 on the lateral side 24 and a vertex (not shown) on the medial side 22. As shown in FIG. 4, at a first position along the longitudinal axis $A_F$, the height of the heel counter 270 may be less than the height of the sidewall 234 of the outer sole member 230, such that the heel counter 270 extends partially up the sidewall 234. However, as shown in FIG. 5, at a second position along the longitudinal axis $A_F$ adjacent to or at the vertex, the height of the heel counter 270 may be greater than the height of the sidewall 234, such that the heel counter 270 extends over the sidewall 234 and attaches to the upper 100.

During use, the bladder 208, the outer sole member 230, and the inner sole member 260 may cooperate to enhance the functionality and cushioning characteristics that a conventional midsole provides, while simultaneously providing increased stability and support for the foot by dampening oscillations of the foot that occur in response to a ground-reaction force during use of the footwear 10. For instance, an applied load to the sole structure 200 during forward movements, such as walking or running movements, may cause some of the segments 218*a*-218*c* to compress to provide cushioning for the foot by attenuating the ground-reaction force, while other segments 218*a*-218*c* may retain their shape to impart stability and support characteristics that dampen foot oscillations relative to the footwear 10 responsive to the initial impact of the ground-reaction force.

The following Clauses provide an exemplary configuration for an article of footwear described above.

Clause 1: A sole structure for an article of footwear, the sole structure comprising a forefoot region disposed adjacent an anterior end, a heel region disposed adjacent a posterior end, a mid-foot region disposed intermediate the forefoot region and the heel region, a fluid-filled bladder having a first segment extending along a medial side in the heel region, a second segment extending along a lateral side in the heel region, and a web area disposed between the first segment and the second segment, the first segment, the second segment, and the web area defining a pocket, and an outer sole member having an upper portion extending from a first end in the forefoot region to a second end in the heel region and received on a first side of the web area and a rib extending downwardly from the upper portion within the forefoot region and defining a cavity in a forefoot region of the sole structure, the cavity cooperating with the pocket of the fluid-filled bladder to define a recess that extends continuously from the forefoot region to the heel region.

Clause 2: The sole structure of Clause 1, further comprising an inner sole member extending from a first end disposed within the cavity to a second end received on a second side of the web area opposite the outer sole member.

Clause 3: The sole structure of Clause 2, wherein the outer sole member is formed of a first foamed polymeric material and the inner sole member is formed of a second polymeric material having a greater density than the first foamed polymeric material.

Clause 4: The sole structure of Clause 2, wherein each of fluid-filled bladder, the outer sole member, and the inner sole member defines a portion of a ground-contacting surface of the sole structure.

Clause 5: The sole structure of Clause 1, wherein the rib is formed along an outer periphery of the sole structure in the forefoot region and the mid-foot region.

Clause 6: The sole structure of Clause 1, wherein the rib has a first width in the mid-foot region and a second width in the forefoot region.

Clause 7: The sole structure of Clause 1, wherein the first segment terminates at a first distal end in the mid-foot region and the second segment terminates at a second distal end in the mid-foot region, and wherein the rib extends continuously from a first terminal end opposing the first distal end in the mid-foot region to a second terminal end opposing the second distal end in the mid-foot region.

Clause 8: The sole structure of Clause 1, wherein the rib includes a first segment extending along the lateral side within the mid-foot region and a second segment extending along the lateral side within the forefoot region, the second segment having a greater width than the first segment.

Clause 9: The sole structure of Clause 1, wherein the fluid-filled bladder further includes a third segment fluidly coupling the first segment to the second segment and extending along an arcuate path around the posterior end, and a thickness of the fluid-filled bladder tapers continuously and at a constant rate from the posterior end to a first distal end.

Clause 10: The sole structure of Clause 9, further comprising a heel counter extending along each of the first segment, the second segment, and the third segment and formed of the same material as the fluid-filled bladder.

Clause 11: A sole structure for an article of footwear, the sole structure comprising a fluid-filled bladder disposed in a heel region of the sole structure and tapering from a first thickness at a posterior end of the sole structure to a second thickness at a mid-foot region of the sole structure, an outer sole member including an upper portion extending from a first end in a forefoot region of the sole structure to a second end received by the fluid-filled bladder, and a rib extending downwardly from the first end of the upper portion and defining a cavity in a forefoot region of the sole structure, and an inner sole member having a first end received in the cavity of the outer sole member and a second end received by the fluid-filled bladder in the heel region.

Clause 12: The sole structure of Clause 11, further comprising a heel counter extending from the fluid-filled bladder and overlaying the upper portion of the outer sole member.

Clause 13: The sole structure of Clause 11, wherein the fluid-filled bladder, the outer sole member, and the inner sole member each define a portion of a ground-engaging surface of the sole structure.

Clause 14: The sole structure of Clause 13, wherein each of the fluid-filled bladder, the outer sole member, and the inner sole member includes one or more traction elements disposed on the ground-engaging surface.

Clause 15: The sole structure of Clause 14, wherein a first plurality of the traction elements includes protuberances extending therefrom and a second plurality of the traction elements includes a plurality of serrations formed therein.

Clause 16: The sole structure of Clause 14, wherein the one or more traction elements includes a first plurality of quadrilateral-shaped traction elements along the first segment of the fluid-filled bladder, a first D-shaped traction element disposed at a distal end of the first segment of the fluid-filled bladder, a second plurality of quadrilateral-shaped traction elements along a medial side of the rib, a second D-shaped traction element disposed at a terminal end of the rib and opposing the first D-shaped traction element, and at least one of an anterior traction element and a posterior traction element extending from the medial side to the lateral side.

Clause 17: The sole structure of Clause 11, wherein the outer sole member includes a plurality of channels formed in a lower surface of the rib along a direction from a medial side of the sole structure to a lateral side of the sole structure.

Clause 18: The sole structure of Clause 11, wherein the first end of the inner sole member includes a traction element extending from the forefoot region through the mid-foot region and having a plurality of serrations formed therein.

Clause 19: The sole structure of Clause 11, wherein the second end of the inner sole member includes a bulge disposed within the fluid-filled bladder and having a convex shape.

Clause 20: The sole structure of Clause 11, wherein the outer sole member includes a sidewall configured to extend onto an upper of the article of footwear.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a forefoot region disposed adjacent an anterior end;

a heel region disposed adjacent a posterior end;

a mid-foot region disposed intermediate the forefoot region and the heel region;

a fluid-filled bladder having a first segment extending along a medial side of the sole structure in the heel region and a second segment extending along a lateral side of the sole structure in the heel region, the first segment and the second segment defining a pocket in the heel region;

an outer sole member including a rib disposed within the forefoot region, the rib (i) cooperating with the first segment of the fluid-filled bladder and the second segment of the fluid-filled bladder to define an outer perimeter of the sole structure and (ii) defining a cavity in the forefoot region that cooperates with the pocket of the fluid-filled bladder to define a recess that extends from the forefoot region to the heel region; and an inner sole member disposed within the recess and tapering in a direction from a center of the sole structure to at least one of the first segment, the second segment, and the rib.

2. The sole structure of claim 1, wherein the first segment of the fluid-filled bladder, the second segment of the fluid-filled bladder, and the rib of the outer sole member cooperate to define a sidewall that extends continuously around the inner sole member.

3. The sole structure of claim 1, wherein the outer sole member is formed of a first foamed polymeric material and the inner sole member is formed of a second polymeric material having a greater density than the first foamed polymeric material.

4. The sole structure of claim 1, wherein the rib is formed along an outer periphery of the sole structure in the forefoot region and the mid-foot region.

5. The sole structure of claim 1, wherein the rib has a first width in the mid-foot region and a second width in the forefoot region.

6. The sole structure of claim 1, wherein the first segment terminates at a first distal end in the mid-foot region and the second segment terminates at a second distal end in the mid-foot region, and wherein the rib extends continuously from a first terminal end opposing the first distal end in the mid-foot region to a second terminal end opposing the second distal end in the mid-foot region.

7. The sole structure of claim 1, wherein the rib includes a first rib segment extending along the lateral side within the mid-foot region and a second rib segment extending along the lateral side within the forefoot region, the second rib segment having a greater width than the first rib segment.

8. The sole structure of claim 1, wherein the fluid-filled bladder further includes a third segment fluidly coupling the first segment to the second segment and extending along an arcuate path around the posterior end, a thickness of the fluid-filled bladder tapering continuously and at a constant rate from the posterior end to a first distal end of the fluid-filled bladder.

9. The sole structure of claim 8, further comprising a heel counter extending along each of the first segment, the second segment, and the third segment and formed of the same material as the fluid-filled bladder.

10. A sole structure for an article of footwear, the sole structure comprising:

a fluid-filled bladder disposed in a heel region of the sole structure and tapering from a first thickness at a posterior end of the sole structure to a second thickness at a mid-foot region of the sole structure, the fluid-filled bladder including a first segment extending along a medial side of the sole structure and a second segment extending along a lateral side of the sole structure;

an outer sole member including a rib defining a cavity in a forefoot region of the sole structure, the rib cooperating with the first segment and the second segment to define an outer perimeter of the sole structure; and an inner sole member received by the cavity in the forefoot region of the outer sole member and by the fluid-filled bladder in the heel region, the inner sole member tapering in a direction from a center of the sole structure to at least one of the fluid-filled bladder and the rib.

11. The sole structure of claim 10, further comprising a heel counter extending from the fluid-filled bladder and overlaying an upper portion of the outer sole member.

12. The sole structure of claim 10, wherein each of the fluid-filled bladder, the outer sole member, and the inner sole member includes one or more traction elements disposed on a ground-contacting surface of the sole structure.

13. The sole structure of claim 12, wherein a first plurality of the traction elements includes protuberances extending therefrom and a second plurality of the traction elements includes a plurality of serrations formed therein.

14. The sole structure of claim 10, wherein the outer sole member includes a plurality of channels formed in a lower surface of the rib along a direction from a medial side of the sole structure to a lateral side of the sole structure.

15. The sole structure of claim 10, wherein the inner sole member includes a traction element extending from the forefoot region through the mid-foot region and having a plurality of serrations formed therein.

16. The sole structure of claim 10, wherein the inner sole member includes a bulge disposed within the fluid-filled bladder and having a convex shape.

17. The sole structure of claim 10, wherein the outer sole member includes a sidewall configured to extend onto an upper of the article of footwear.

18. A sole structure for an article of footwear, the sole structure comprising:

a fluid-filled bladder disposed in a heel region of the sole structure and tapering from a first thickness at a posterior end of the sole structure to a second thickness at a mid-foot region of the sole structure;

an outer sole member including a rib defining a cavity in a forefoot region of the sole structure; and an inner sole member received by the cavity of the outer sole member and by the fluid-filled bladder, the inner sole member tapering in a direction from a center of the sole structure to at least one of the fluid-filled bladder and the rib, each of the fluid-filled bladder, the outer sole member, and the inner sole member including one or more traction elements disposed on a ground-contacting surface of the sole structure.

* * * * *